US012655492B2

(12) United States Patent
Koo et al.

(10) Patent No.: US 12,655,492 B2
(45) Date of Patent: Jun. 16, 2026

(54) ULTRAHIGH STRENGTH COLD-ROLLED STEEL SHEET AND MANUFACTURING METHOD THEREOF

(71) Applicant: POSCO, Pohang-si (KR)

(72) Inventors: Min-Seo Koo, Gwangyang-si (KR); In-Shik Suh, Pohang-si (KR)

(73) Assignee: POSCO CO., LTD, Gyeongsangbuk-Do (KR)

( * ) Notice: Subject to any disclaimer, the term of this patent is extended or adjusted under 35 U.S.C. 154(b) by 0 days.

(21) Appl. No.: 16/765,960

(22) PCT Filed: Dec. 20, 2018

(86) PCT No.: PCT/KR2018/016371
§ 371 (c)(1),
(2) Date: May 21, 2020

(87) PCT Pub. No.: WO2019/125018
PCT Pub. Date: Jun. 27, 2019

(65) Prior Publication Data

US 2020/0362430 A1 Nov. 19, 2020

(30) Foreign Application Priority Data

Dec. 24, 2017 (KR) ..... 10-2017-0178957

(51) Int. Cl.

| | |
|---|---|
| ***C21D 8/0221*** | (2026.01) |
| ***C21D 8/04*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/32*** | (2006.01) |

(52) U.S. Cl.
CPC ..... *C21D 8/0236* (2013.01); *C21D 8/0226* (2013.01); *C21D 8/0473* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/32* (2013.01); *C21D 2211/002* (2013.01); *C21D 2211/005* (2013.01); *C21D 2211/008* (2013.01)

(58) Field of Classification Search
CPC ..... C21D 8/0236; C21D 8/0226; C21D 2211/008; C22C 38/04
See application file for complete search history.

(56) References Cited

U.S. PATENT DOCUMENTS

| | | | | |
|---|---|---|---|---|
| 2011/0048589 | A1* | 3/2011 | Matsuda | C23C 2/0224 148/333 |
| 2013/0048151 | A1 | 2/2013 | Kawamura et al. | |
| 2015/0267281 | A1 | 9/2015 | Song et al. | |
| 2017/0081741 | A1 | 3/2017 | Tabata et al. | |
| 2018/0030565 | A1 | 2/2018 | Hasegawa et al. | |
| 2018/0135145 | A1 | 5/2018 | Suwa et al. | |
| 2018/0171429 | A1 | 6/2018 | Suwa et al. | |
| 2018/0363090 | A1 | 12/2018 | Koo et al. | |
| 2019/0071745 | A1 | 3/2019 | Lee et al. | |

FOREIGN PATENT DOCUMENTS

| | | | | |
|---|---|---|---|---|
| CN | 107208237 | A | | 9/2017 |
| EP | 3257961 | A1 | | 12/2017 |
| JP | 06271942 | A | * | 9/1994 |
| JP | 2005205477 | A | * | 8/2005 |
| JP | 2010-065272 | A | | 3/2010 |
| JP | 2010-090432 | A | | 4/2010 |
| JP | 2010174282 | A | * | 8/2010 |
| JP | 2013227614 | A | * | 11/2013 |
| JP | 2014-196557 | A | | 10/2014 |
| KR | 10-2012-0063198 | A | | 6/2012 |
| KR | 20120063198 | A | * | 6/2012 |
| KR | 10-2012-0074798 | A | | 7/2012 |
| KR | 20120074798 | A | * | 7/2012 |
| KR | 10-2014-0031753 | A | | 3/2014 |

(Continued)

OTHER PUBLICATIONS

Nagataki, Yasunobu, JP-06271942-A Machine Translation, 1994 (Year: 1994).*

(Continued)

*Primary Examiner* — Jonathan Johnson
(74) *Attorney, Agent, or Firm* — Morgan Lewis & Bockius LLP

(57) ABSTRACT

An ultrahigh strength cold-rolled steel sheet and a manufacturing method thereof are provided. An ultrahigh strength cold-rolled steel sheet, according to a preferred aspect of the present invention, comprises, in percentage by weight: C: 0.25 to 0.4%; Si: 0.5% or less (excluding 0); Mn: 3.0 to 4.0%; P: 0.03% or less (excluding 0); S: 0.015% or less (excluding 0); Al: 0.1% or less; Cr: 1% or less (excluding 0); Ti: 48/14*[N] to 0.1% or less; Nb: 0.1% or less (excluding 0); B: 0.005% or less (excluding 0); N: 0.01% or less (excluding 0); and a balance of Fe and unavoidable impurities, and a microstructure includes 90% or more (including 100%) of martensite, and one or two kinds of 10% or less (including 0%) of ferrite and bainite.

6 Claims, 2 Drawing Sheets

(56) References Cited

FOREIGN PATENT DOCUMENTS

| | | | |
|---|---|---|---|
| KR | 10-2014-0037180 | A | 3/2014 |
| KR | 10-2014-0055463 | A | 5/2014 |
| KR | 10-2017-0026490 | A | 3/2017 |
| KR | 10-2017-0113858 | A | 10/2017 |
| WO | 2013/082188 | A1 | 6/2013 |
| WO | 2015/182596 | A1 | 12/2015 |
| WO | 2016/129213 | A1 | 8/2016 |
| WO | 2016/163468 | A1 | 10/2016 |
| WO | 2016/163469 | A1 | 10/2016 |
| WO | 2017/111407 | A1 | 6/2017 |

OTHER PUBLICATIONS

Hwan-Gu Seong, KR-20120074798-A patent application machine translation, Jul. 6, 2012 (Year: 2012).*

Yoshimasa Funakawa et al., JP-2010174282-A description machine translation, Aug. 12, 2010 (Year: 2010).*

Seong Kim et al., KR-20120063198-A patent application machine translation, Jun. 15, 2012 (Year: 2012).*

Fujita N, JP-2013227614-A machine translation, Nov. 7, 2013 (Year: 2013).*

L. Chen, Flattening, Leveling, Slitting, and Shearing of Coiled Product, 2006, ASM Handbook, vol. 14B, pp. 46-56 (Year: 2006).*

European Search Report dated Sep. 9, 2020 issued in European Patent Application No. 18892025.0.

International Search Report dated Mar. 27, 2019 issued in International Patent Application No. PCT/KR2018/016371 (with English translation).

Japanese Office Action dated Jul. 6, 2021 issued in Japanese Patent Application No. 2020-531478.

Rong Xiaojun et al., Gas Welder, Shandong Provincial Industrial Equipment Installation Corporation, p. 215, Nov. 1993.

Song Weixi, Metallurgy, Beijing University of Science and Technology, p. 215, May 1, 1989 (May 1, 1989).

Reexamination Notification dated Jul. 11, 2025 issued in the corresponding Chinese Patent Application No. 201880082890.1 with the English translation.

* cited by examiner

[FIG. 1]
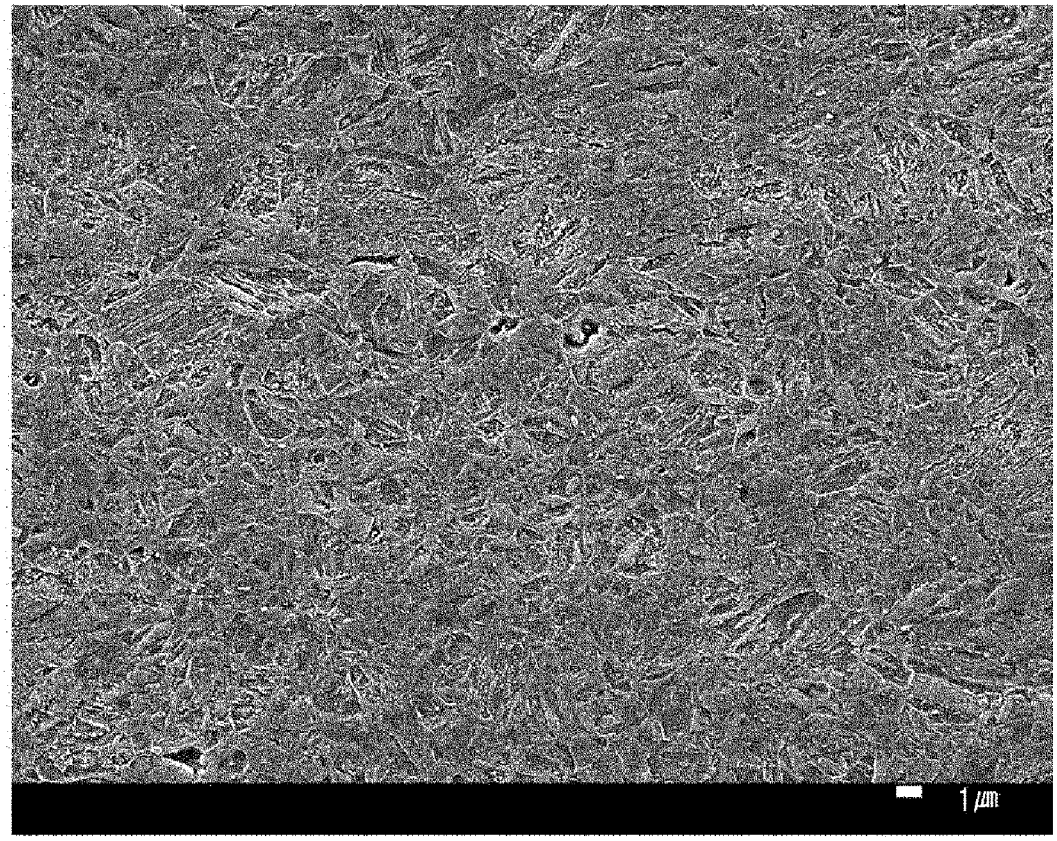

[FIG. 2]
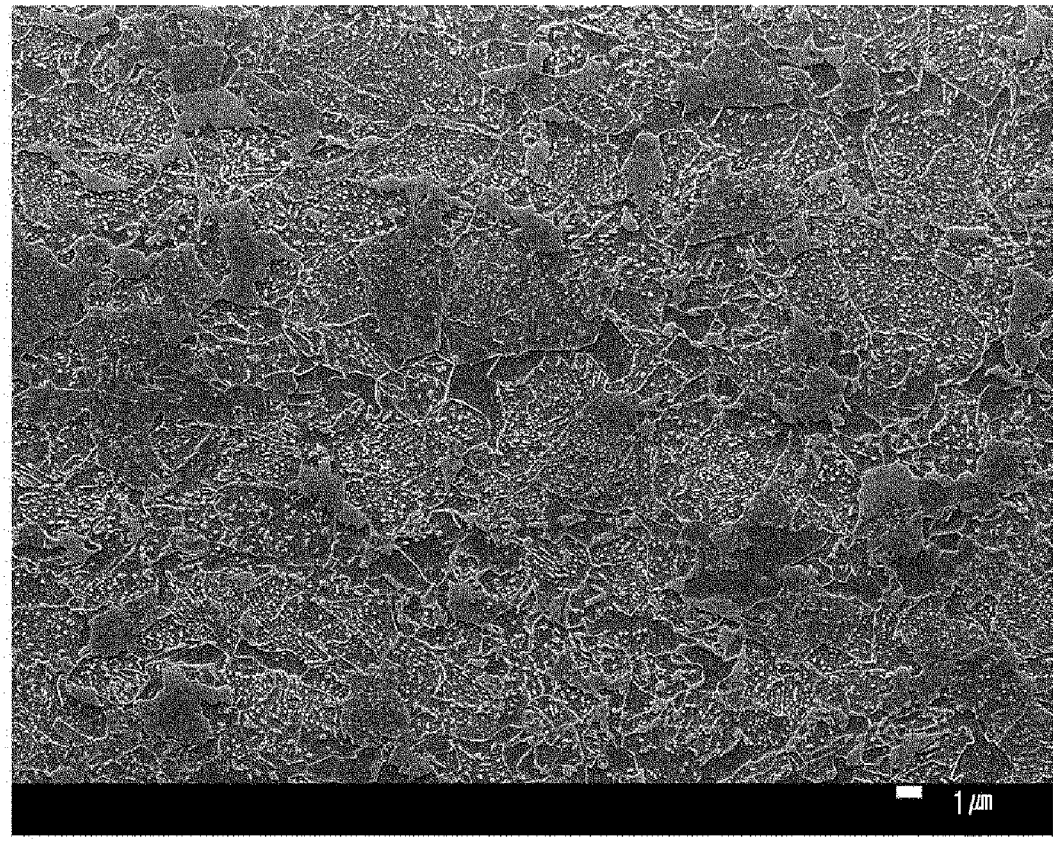
[FIG. 3]
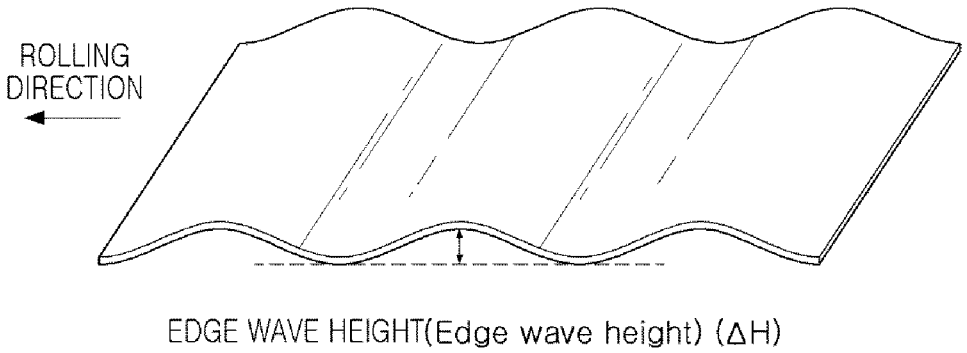

ULTRAHIGH STRENGTH COLD-ROLLED STEEL SHEET AND MANUFACTURING METHOD THEREOF

CROSS-REFERENCE OF RELATED APPLICATIONS

This application is the U.S. National Phase under 35 U.S.C. § 371 of International Patent Application No. PCT/KR2018/016371, filed on Dec. 20, 2018, which in turn claims the benefit of Korean Application No. 10-2017-0178957, filed on Dec. 24, 2017, the entire disclosures of which applications are incorporated by reference herein.

TECHNICAL FIELD

The present disclosure relates to a high strength cold-rolled steel sheet used in automobile collision absorbing and structural members, and more particularly, to a tensile strength ultrahigh strength cold-rolled steel sheet having an excellent shape quality and a manufacturing method thereof.

BACKGROUND ART

In order to meet the contradictory goals of reducing the weight of automobile steel plates and securing collision safety for passenger safety, as well as preserving the global environment, various automobile steel plates such as dual phase (DP) steel, transformation induced plasticity (TRIP) steel, complex phase (CP) steel, etc, are being developed. However, the tensile strength that can be implemented in such advanced high strength steel is limited to about the 1200 Mpa level. Hot press formed steel, which secures final strength by rapid cooling through a direct contact with the die, has been highlighted for application to a structural member to secure the collision safety, but an expansion of application may not be high, due to excessive investment costs in equipment and high heat-treatment and process costs.

Compared to general press forming and hot press forming, a roll forming method having high productivity is a method of manufacturing a complex shape through multi-stage roll forming, and its application to forming parts of ultra-high strength materials having low elongation is expanding. It is mainly produced in a continuous annealing furnace equipped with a water cooling facility, and a microstructure represents a tempered martensitic structure tempering martensite. There is a disadvantage in that the shape quality may be inferior due to temperature deviation in a width direction and a length direction when water is cooled, thereby deteriorating workability and material deviation by location when applying roll forming. Therefore, there is a need to devise an alternative to the rapid cooling method through water cooling.

As an ultra-high-strength steel manufacturing technology with excellent shape, there is a manufacturing method of an ultra-high strength cold-rolled steel sheet with improved shape quality while having strength of 1 GPa or higher in Patent Document 1, and the shape quality is secured by limiting ΔT and alloying components during quenching in an annealing furnace. In addition, in the case of Patent Document 2 provides a manufacturing method of a cold-rolled steel sheet obtaining high strength and high ductility utilizing tempered martensite at the same time and having an excellent plate shape after continuous annealing, as there may be a possibility of causing dents in a furnace due to a high Si content.

In addition, Patent Document 3 provides a manufacturing method that realizes a tensile strength of 1700 MPa using a water cooling method, but the thickness is limited to 1 mm or less, and in Patent Document 3, there is a still a problem of the shape quality deterioration and material deviation by location, which are disadvantages of martensitic steel using the existing water cooling method.

PRIOR ART DOCUMENT (Patent Document 1) Korean Patent Laid-Open Publication No. 2012-0063198

(Patent Document 2) Japan Patent Laid-Open Publication No. 2010-090432

(Patent Document 3) Korean Patent Laid-Open Publication No. 2017-7001783

DISCLOSURE

Technical Problem

A preferred aspect of the present disclosure is to provide an ultrahigh strength cold-rolled steel sheet having excellent shape quality and a manufacturing method thereof.

Another preferred aspect of the present disclosure is to provide a manufacturing method of the ultrahigh strength cold-rolled steel sheet having excellent shape quality.

Technical Solution

According to a preferred aspect of the present disclosure, an ultrahigh strength cold-rolled steel sheet includes, in percentage by weight: C: 0.25 to 0.4%; Si: 0.5% or less (excluding 0); Mn: 3.0 to 4.0%; P: 0.03% or less (excluding 0); S: 0.015% or less (excluding 0); Al: 0.1% or less (excluding 0); Cr: 1% or less (excluding 0); Ti: 48/14*[N] to 0.1% or less; Nb: 0.1% or less (excluding 0); B: 0.005% or less (excluding 0); N: 0.01% or less (excluding 0); and a balance of Fe and other unavoidable impurities, and a microstructure includes 90% or more (including 100%) of martensite, and one or two kinds of 10% or less (including 0%) of ferrite and bainite.

According to another preferred aspect of the present disclosure, a manufacturing method of an ultrahigh strength cold-rolled steel sheet includes operations of:

- heating a steel slab including, in percentage by weight, C: 0.25 to 0.4%; Si: 0.5% or less (excluding 0); Mn: 3.0 to 4.0%; P: 0.03% or less (excluding 0); S: 0.015% or less (excluding 0); Al: 0.1% or less (excluding 0); Cr: 1% or less (excluding 0); Ti: 48/14*[N] to 0.1% or less; Nb: 0.1% or less (excluding 0); B: 0.005% or less (excluding 0); N: 0.01% or less (excluding 0), and a balance of Fe and other unavoidable impurities, to a temperature of 1100 to 1300° C.;
- hot rolling the heated steel slab under a finish hot rolling temperature condition of $Ar_3$ or higher to obtain a hot-rolled steel sheet;
- coiling the hot-rolled steel sheet at a temperature of 720° C. or lower;
- cold rolling the hot-rolled steel sheet to obtain a cold-rolled steel sheet;
- performing annealing heat treatment on the cold-rolled steel sheet in a temperature range of 780 to 880° C.;
- primary cooling the annealing heat-treated cold-rolled steel sheet as described above to a primary cooling end temperature of 700 to 650° C. at a cooling rate of 5° C./sec or less; and secondary cooling the primary cooled cold-rolled steel sheet as described above to a secondary cooling end temperature (RCS) of 320° C. or higher at a cooling rate of 5° C./sec or more, wherein the C, Mn, and Cr, and the secondary cooling end temperature (RCS) satisfy the following Relationship 1, $$1200[C]+498.1[Mn]+204.8[Cr]-0.91[RCS]>1560 \quad \text{[Relationship 1]}$$

(Here, C, Mn, and C represent a content of each component in percentage by weight, and RCS represents a secondary cooling end temperature).

Advantageous Effects

According to a preferred aspect of the present disclosure, a cold-rolled steel sheet having superior shape quality compared to martensitic steel produced by utilizing water cooling as well as having ultra-strength of tensile strength of 1700 MPa or more by utilizing a conventional continuous annealing furnace in which a slow cooling section is present can be provided.

DESCRIPTION OF DRAWINGS

FIG. 1 is a scanning electron microscope tissue picture of Inventive Example 1 showing an example of a steel sheet conforming to the present invention.

FIG. 2 is a scanning electron microscope tissue picture of Comparative Example 10 showing a steel sheet outside the scope of the present disclosure.

FIG. 3 schematically illustrates a concept of wave height used to measure the shape quality of the present disclosure.

BEST MODE FOR INVENTION

An aspect of the present disclosure is to provide an ultra-high strength cold-rolled steel sheet having excellent shape quality without generating waves in a width direction and a length direction caused by rapid cooling by utilizing an existing water-cooling facility and a manufacturing method including the same.

Hereinafter, an ultra-high strength cold-rolled steel sheet according to a preferred aspect of the present disclosure will be described.

According to a preferred aspect of the present disclosure, an ultrahigh strength cold-rolled steel sheet includes, in percentage by weight: C: 0.25 to 0.4%; Si: 0.5% or less (excluding 0); Mn: 3.0 to 4.0%; P: 0.03% or less (excluding 0); S: 0.015% or less (excluding 0); Al: 0.1% or less (excluding 0); Cr: 1% or less (excluding 0); Ti: 48/14*[N] to 0.1% or less; Nb: 0.1% or less (excluding 0); B: 0.005% or less (excluding 0); N: 0.01% or less (excluding 0); and a balance of Fe and other unavoidable impurities.

Carbon (C): 0.25 to 0.4% by Weight (Hereinafter, Also Referred to as %)

Carbon (C) is a component required to secure martensite strength, and should be added at least 0.25% or more. However, if a content thereof exceeds 0.4%, weldability becomes inferior, so an upper limit thereof is limited to 0.4%. Therefore, the content of C is preferably 0.25 to 0.4%, and more preferably 0.25 to 0.3%.

Silicon (Si): 0.5% or Less (Excluding 0)

Silicon (Si) is a ferrite stabilizing element and has a disadvantage of weakening strength by promoting ferrite generation during slow cooling after annealing after annealing in an ordinary continuous annealing furnace in which a slow cooling section exists. As in the present disclosure, when a large amount of Mn is added for suppressing phase transformation, it is desirable to limit the content thereof to 0.5% or less (excluding 0) because there is a risk of causing dent defects due to surface concentration and oxidation by Si during annealing. The content of Si is more preferably 0.2% or less.

Manganese (Mn): 3.0 to 4.0%

Manganese (Mn) in steel is an element that inhibits ferrite formation and facilitates austenite formation. When a content of Mn is less than 3%, ferrite is easily generated during slow cooling, and when a content of Mn exceeds 4%, bands are formed due to segregation and a cost of ferroalloy is increased due to excessive alloy inputs during converter operation, so the content thereof is preferably limited to 3.0 to 4.0%. The content of Mn is more preferably 3.0 to 3.6%.

Phosphorus (P): 0.03% or Less (Excluding 0)

Phosphorus (P) in steel is an impurity element, and if a content thereof exceeds 0.03%, weldability decreases, a risk of brittleness of the steel increases, and a possibility of causing dent defects increases, so an upper limit thereof is preferably limited to 0.03%. The content of P is more preferably 0.02% or less.

Sulfur (S): 0.015% or Less (Excluding 0)

Sulfur (S), like P, is an impurity element in steel, and is an element that inhibits the ductility and weldability of the steel sheet. When a content thereof exceeds 0.015%, there is a high possibility of inhibiting the ductility and weldability of the steel sheet, so an upper limit thereof is preferably limited to 0.015%. The content of S is more preferably 0.01% or less.

Aluminum (Al): 0.1% or Less (Excluding 0)

Aluminum (Al) is an alloy element that expands a ferrite region. When utilizing the continuous annealing process in which slow cooling is present as in the present disclosure, it promotes ferrite formation, and it is possible to deteriorate high-temperature hot rollability due to AlN formation, so a content of aluminum (Al) is preferably limited to 0.1% or less (excluding 0). The content of Al is more preferably 0.05% or less.

Chromium (Cr): 1% or Less (Excluding 0)

Chromium (Cr) is an alloy element that facilitates securing a low-temperature transformation structure by suppressing ferrite transformation, and has the advantage of suppressing ferrite formation when utilizing a continuous annealing process in which slow cooling is present, as in the present disclosure, but when it exceeds 1%, since costs of ferroalloy increase due to excessive amounts of alloy input, it is desirable to limit the content thereof to 1% or less (excluding 0).

Titanium (Ti): 48/14*[N] TO 0.1%

Titanium (Ti) is a nitride forming element and precipitates TiN in the steel by scavenging N. To this end, it is necessary to add 48/14*[N] or more in a chemical equivalent. When Ti is not added, it is necessary to add it because it is concerned about cracks generation during continuous casting due to AlN formation, and if Ti exceeds 0.1%, a strength of martensite is reduced due to additional carbide precipitation in addition to removal of soluble N, so the content of titanium (Ti) is preferably limited to 48/14*[N] to 0.1%.

Niobium (Nb): 0.1% or Less (Excluding 0)

Niobium (Nb) is an element that segregates at an austenite grain boundary and suppresses coarsening of austenite grains during annealing heat treatment, so it is necessary to add it. When it exceeds 0.1%, a cost of ferroalloy due to excessive amounts of alloy input increases, so a content of niobium (Nb) is preferably limited to 0.1% or less (excluding 0). The content of Nb is more preferably 0.05% or less.

Boron (B): 0.005% or Less (Excluding 0)

Boron (B) is a component that inhibits ferrite formation, and has an advantage of suppressing the ferrite formation upon cooling after annealing. When the content of B exceeds 0.005%, the ferrite formation may be promoted by precipitation of Fe23(C,B)6, so a content of boron (B) is preferably limited to 0.005% or less (excluding 0). The content of Bis more preferable to be 0.003%.

Nitrogen (N): 0.01% or Less (Excluding 0)

When nitrogen (N) exceeds 0.01%, a risk of crack generation during continuous casting through AlN formation, or the like is greatly increased, so the upper limit thereof is preferably limited to 0.01%.

A balance consists of Fe and other unavoidable impurities.

The ultrahigh strength cold-rolled steel sheet according to a preferred aspect of the present disclosure, wherein a microstructure includes 90% or more (including 100%) of martensite, and one or two kinds of 10% or less (including 0%) of ferrite and bainite.

The martensite is a structure that increases strength, and its fraction is preferably 90% or more. The fraction of martensite may be 100%.

The ferrite and bainite are unfavorable structures in terms of tensile strength, and ferrite or bainite phases are likely to be mixed in the continuous annealing process in a method of manufacturing martensitic steel by delaying transformation by using hardenable elements such as Mn, C, and the like, not in a manufacturing process of martensitic steel by a rapid cooling method. Accordingly, in the present disclosure, the fraction of one or two kinds of ferrite and bainite is limited to 10% or less. The ferrite and bainite may not be included.

The ultrahigh strength cold-rolled steel sheet according to a preferred aspect of the present disclosure has excellent shape quality without generating waves in a width direction and a longitudinal direction, and may have a tensile strength of 1700 MPa or more.

The cold-rolled steel sheet may have a wave height (ΔH) of 3 mm or less in an edge portion after cutting a steel plate to a size of 1000 mm in a longitudinal direction.

Hereinafter, a manufacturing method of an ultrahigh strength cold-rolled steel sheet according to another preferred aspect of the present disclosure will be described.

According to another preferred aspect of the present disclosure, a manufacturing method of an ultrahigh strength cold-rolled steel sheet includes operations of:

heating a steel slab including, in percentage by weight, C: 0.25 to 0.4%; Si: 0.5% or less (excluding 0); Mn: 3.0 to 4.0%; P: 0.03% or less (excluding 0); S: 0.015% or less (excluding 0); Al: 0.1% or less (excluding 0); Cr: 1% or less (excluding 0); Ti: 48/14*[N] to 0.1% or less; Nb: 0.1% or less (excluding 0); B: 0.005% or less (excluding 0); N: 0.01% or less (excluding 0); and a balance of Fe and other unavoidable impurities, to a temperature of 1100 to 1300° C.;

hot rolling the heated steel slab under a finish hot rolling temperature condition of $Ar_3$ or higher to obtain a hot-rolled steel sheet;

coiling the hot-rolled steel sheet at a temperature of 720° C. or lower;

cold rolling the hot-rolled steel sheet to obtain a cold-rolled steel sheet;

performing annealing heat treatment on the cold-rolled steel sheet in a temperature range of 780 to 880° C.;

primary cooling the annealing heat-treated cold-rolled steel sheet as described above to a primary cooling end temperature of 700 to 650° C. at a cooling rate of 5° C./sec or less; and secondary cooling the primary cooled cold-rolled steel sheet as described above to a secondary cooling end temperature (RCS) of 320° C. or higher at a cooling rate of 5° C./sec or more, wherein the C, Mn, and Cr, and the secondary cooling end temperature (RCS) satisfy the following Relationship 1, $$1200[C]+498.1[Mn]+204.8[Cr]-0.91[RCS]>1560 \quad \text{[Relationship 1]}$$

(Here, C, Mn, and C represent a content of each component in percentage by weight, and RCS represents a secondary cooling end temperature).

Slab Heating Operation

First, a slab satisfying the above-described composition is heated to a temperature range of 1100 to 1300° C. When the heating temperature is less than 1100° C., a problem in which a hot rolling load increases rapidly occurs, and when the heating temperature exceeds 1300° C., an amount of surface scale increases, which may lead to loss of materials. Therefore, the slab heating temperature is preferably limited to 1100 to 1300° C.

Operation of Obtaining Hot-Rolled Steel Sheet

The heated steel slab is hot-rolled under a finish hot rolling temperature condition of $Ar_3$ or higher to obtain a hot-rolled steel sheet. Here, $Ar_3$ means the temperature at which ferrite starts to appear when austenite is cooled.

When the finishing hot rolling temperature is less than $Ar_3$, second-phase region of ferrite+austenite or ferrite region rolling is formed, resulting in a mixed structure, and there is concern about malfunction due to fluctuation of a hot rolling load, so it is desirable that the finish hot rolling temperature is limited to $Ar_3$ or higher. The preferred finish hot rolling temperature is 850 to 1000° C.

Coiling Operation

The hot-rolled steel sheet is wound at a temperature of 720° C. or lower.

When a coiling temperature exceeds 720° C., an oxide film on a surface of the steel sheet may be excessively generated, which may cause defects, so the coiling temperature is limited to 720° C. or less. There may be a problem in which the lower the coiling temperature, the higher the strength of the hot-rolled steel sheet, and the lower the rolling load of the cold rolling, which is a post process, but a lower limit thereof is not limited because the problem is not a factor that makes actual production impossible. More preferably, the coiling temperature is 600° C. or less.

Obtaining Cold-Rolled Steel Sheet

The hot-rolled steel sheet manufactured as described above is cold rolled to obtain a cold-rolled steel sheet. During the cold rolling, a reduction ratio is preferably 40 to 70%.

Before the cold rolling, pickling treatment may be performed.

Annealing Heat Treatment Operation

The cold-rolled steel sheet manufactured as described above is annealing heat treated in a temperature range of 780 to 880° C.

The annealing heat treatment may be performed by a continuous annealing method.

When the annealing temperature is less than 780° C., there is a concern in material deviation due to a drop in strength by formation large amounts of ferrite and generation of temperature gradient of top and end portions of an invention coil during connection with other steel types annealed in 800° C. or higher. Meanwhile, if the annealing temperature exceeds 880° C., production may be difficult due to deterioration of durability of the continuous annealing furnace.

Therefore, the annealing temperature is preferably limited to 780 to 880° C.

Primary Cooling (Slow Cooling Section Cooling) Operation

The cold-rolled steel sheet which is annealing heat-treated as described above is primarily cooled to a primary cooling end temperature of 700 to 650° C. at a cooling rate of 5° C./sec or less.

In general, in the case of a continuous annealing furnace including a slow cooling section, there is a slow cooling section of 100 to 200 m after annealing, and there is a disadvantage that it is difficult to manufacture ultrahigh strength steel by transforming a soft phase such as ferrite by slow cooling at a high-temperature after annealing. For example, when a slow cooling section of 160 m exists in the continuous annealing furnace, when a mailing speed of a thin steel sheet is 160 m per minute, a time maintained in the slow cooling section means 60 seconds (sec). In addition, for example, when the annealing temperature is 830° C. and a last temperature in the slow cooling section is 650° C., a cooling rate in the slow cooling section is very low at 3° C. per second (sec), so it is very likely that a soft phase such as ferrite is generated. After annealing, it is desirable to limit a cooling rate to 5° C./sec or less because an additional cooling device must be introduced to secure the slow cooling rate to be higher than 5° C./sec.

Secondary Cooling (Rapid Cooling Section Cooling) Operation

The cold-rolled steel sheet that is primarily cooled as described above is secondarily cooled to a secondary cooling end temperature (RCS) of 320° C. or higher at a cooling rate of 5° C./sec or higher.

When the secondary cooling end temperature (RCS) is less than 320° C., there may be a problem in which a yield strength and tensile strength simultaneously increase due to excessive increase in an amount of martensite during over-aging treatment, and ductility is very deteriorated, and in particular, deterioration in workability during roll forming due to shape deterioration due to rapid cooling, so it is preferable to limit it to 320° C. or higher.

The more preferable secondary cooling end temperature (RCS) is 320 to 460° C.

During the secondary cooling, the cooling rate may be 5° C./sec or less, but it is preferable to limit the cooling rate to 5° C./sec or higher to improve productivity.

The more preferable secondary cooling rate is 5 to 20° C./sec.

The C, Mn and Cr and the secondary cooling end temperature (RCS) should satisfy the following Relational Expression 1.

$$1200[C]+498.1[Mn]+204.8[Cr]-0.91[RCS]>1560 \quad \text{[Relationship 1]}$$

(Here, C, Mn and Cr represent a content of each component in weight by percent, and RCS represents a secondary cooling end temperature)

A problem in which bainite, or the like, which is a high-temperature transformation phase, is generated according to the secondary cooling end temperature (RCS), which is a temperature, lower than that of the slow cooling section, so austenite generated during annealing cannot be transformed into martensite, resulting in a sharp deterioration in tensile strength and yield strength, occurs.

In order to obtain a tensile strength of 1700 MPa or more by reducing the generation of ferrite in a general continuous annealing furnace in which the slow cooling section is present and suppressing the generation of bainite, or the like, which is a high-temperature transformation phase during cooling, the C, Mn, and Cr and the secondary cooling end temperature (RCS) must satisfy the above Relational Expression 1.

According to the manufacturing method of the ultrahigh strength cold-rolled steel sheet according to another preferred aspect of the present disclosure, an ultrahigh strength cold-rolled steel sheet having excellent shape quality without generating waves in a width direction and a longitudinal direction, and having a tensile strength of 1700 MPa or more may be manufactured.

The cold-rolled steel sheet may have a wave height (ΔH) of 3 mm or less in an edge portion after cutting a steel plate to a size of 1000 mm in a longitudinal direction.

Mode for Invention

Hereinafter, the present disclosure will be described in more detail through embodiments. The present disclosure is not limited to the following embodiments.

Embodiment

After vacuum melting steel having a composition of Table 1 with an ingot of 34 kg, a hot-rolled slab was prepared through sizing rolling.

By utilizing this, after maintaining the slab at a temperature of 1200° C. for 1 hour, finish rolling at 900° C., charged in a furnace preheated to 680° C., maintained for 1 hour, and then hot rolling coiling was simulated by furnace cooling. After pickling it, cold rolling at a 50% reduction rate, followed by annealing heat treatment at 800° C., followed by slow cooling to 650° C. at a cooling rate of 3° C./sec, followed by cooling at 20° C./sec, which is a conventional cooling rate, to the RSC temperature (secondary cooling end temperature) in Table 2, and subjected to over-aging heat-treatment to manufacture a steel sheet.

The mechanical properties and shape quality of the steel sheet were measured, and the results are shown in Table 2 below.

Here, the shape quality is shown by measuring a wave height (ΔH) in an edge portion after cutting a steel sheet to a size of 1000 mm in a longitudinal direction, as shown in FIG. 3.

In Table 2 below, it represents that RCS: a secondary cooling end temperature, M: martensite, TM: tempered martensite, B: bainite, F: ferrite, TS: tensile strength, YS: yield strength, and El: elongation.

Meanwhile, a microstructure was observed for Inventive Example 1 and Comparative Example 10, and Inventive Example 1 was shown in FIG. 1 and Comparative Example 10 was shown in FIG. 2.

TABLE 1

| Steel type | C | Si | Mn | P | S | Al | Cr | Ti | Nb | B | N | Remarks |
|---|---|---|---|---|---|---|---|---|---|---|---|---|
| 1 | 0.25 | 0.123 | 3 | 0.011 | 0.0032 | 0.027 | 0.994 | 0.018 | 0.016 | 0.0016 | 0.0042 | Inventive steel |
| 2 | 0.248 | 0.12 | 2.87 | 0.01 | 0.0033 | 0.024 | 0.495 | 0.018 | 0.014 | 0.0015 | 0.0048 | Comparative steel |
| 3 | 0.25 | 0.122 | 3.47 | 0.013 | 0.006 | 0.028 | 0.99 | 0.018 | 0.016 | 0.0016 | 0.0045 | Inventive steel |
| 4 | 0.25 | 0.125 | 3.53 | 0.012 | 0.004 | 0.027 | 0.515 | 0.019 | 0.015 | 0.0018 | 0.0048 | Inventive steel |
| 5 | 0.295 | 0.112 | 2.54 | 0.01 | 0.0027 | 0.021 | 0.52 | 0.018 | 0.014 | 0.0013 | 0.0047 | Comparative steel |
| 6 | 0.3 | 0.13 | 3.16 | 0.012 | 0.006 | 0.027 | 1.00 | 0.018 | 0.016 | 0.0016 | 0.0054 | Inventive steel |
| 7 | 0.29 | 0.096 | 3 | 0.011 | 0.0033 | 0.025 | 0.5 | 0.019 | 0.014 | 0.0015 | 0.0033 | Inventive steel |
| 8 | 0.298 | 0.13 | 3.59 | 0.013 | 0.0045 | 0.025 | 1.00 | 0.018 | 0.016 | 0.0017 | 0.0042 | Inventive steel |
| 9 | 0.285 | 0.108 | 3.47 | 0.011 | 0.004 | 0.028 | 0.503 | 0.019 | 0.014 | 0.0017 | 0.0038 | Inventive steel |
| 10 | 0.333 | 0.111 | 2.36 | 0.012 | 0.003 | 0.02 | 0.495 | 0.018 | 0.016 | 0.0016 | 0.0040 | Comparative steel |

TABLE 2

| | | | Microstructure phase fraction | | Mechanical properties | | | Wave | |
|---|---|---|---|---|---|---|---|---|---|
| Steel type | Embodiment No. | RCS (° C.) | M + TM (%) | F + B (%) | TS (MPa) | YS (MPa) | El (%) | height (mm) | Relational Expression 1 |
| 1 | Inventive example 1 | 460 | 98 | 2 | 1908 | 1224 | 7.4 | 2.64 | 1579.3 |
| | Comparative example 1 | 250 | 98.6 | 1.4 | 1926 | 1421 | 6.8 | 7.68 | 1770.4 |
| 2 | Comparative example 2 | 460 | 81 | 19 | 1682 | 934 | 8.9 | 2.58 | 1409.9 |
| 3 | Inventive example 3 | 460 | 98.4 | 1.6 | 1962 | 1284 | 7.2 | 2.82 | 1812.6 |
| 4 | Inventive example 4 | 460 | 97 | 3 | 1964 | 1263 | 7.6 | 2.87 | 1745.2 |
| 5 | Comparative example 5 | 460 | 69 | 31 | 1358 | 743 | 9.8 | 2.28 | 1307.1 |
| 6 | Inventive example 6 | 460 | 97.4 | 2.6 | 2065 | 1288 | 7.2 | 2.46 | 1728.4 |
| 7 | Comparative example 7 | 460 | 72 | 28 | 1689 | 871 | 9.8 | 2.23 | 1526.1 |
| | Inventive example 7 | 320 | 99.2 | 0.8 | 1940 | 1187 | 7.3 | 2.84 | 1653.5 |
| 8 | Inventive example 8 | 460 | 98.5 | 1.5 | 2151 | 1319 | 5.6 | 2.79 | 1936.1 |
| 9 | Inventive example 9 | 460 | 99 | 1 | 2146 | 1300 | 7.7 | 2.69 | 1754.8 |
| 10 | Comparative example 10 | 460 | 36 | 64 | 1163 | 710 | 11.7 | 2.11 | 1257.9 |

As shown in Table 1 and Table 2, Comparative Example 2, Comparative Example 5, and Comparative Example 10 illustrate a steel type in which the content of Mn is outside of the scope of the present disclosure, and it can be seen that the Comparative Example 2, Comparative Example 5, and Comparative Example 10 have a low tensile strength of 1700 MPa or less, and in particular, the Comparative steel 10, which has a very low amount of Mn, has a very low strength that the tensile strength is less than 120 Mpa. In particular, in the case of Comparative Example 10, as shown in FIG. 2, it can be seen that a fraction of ferrite and bainite is high.

On the other hand, Comparative Example 7 illustrates a steel type that satisfies the components and component ranges of the present disclosure, but does not satisfy the Relational expression 1 (1200 [C]+498.1 [Mn]+204.8 [Cr]−0.91 [RCS]>1560), and in the case of Comparative Example 7, the secondary cooling end temperature is 460° C., and a tensile strength is 1700 MPa or less, as shown in Table 2. Meanwhile, in the case of Inventive Example 7, the secondary cooling end temperature is 320° C., which satisfies Relational Expression 1, and represents a tensile strength of 1700 MPa or more.

In the case of the Inventive Examples 1, 3, 4, 6, 7, 8, and 9, as shown in Table 2, it can be seen that not only shows tensile strength of 1700 MPa or more, but also has a low wave height of 3 mm or less, even under continuous annealing operation conditions including slow cooling by including Relational Expression 1 (1200[C]+498.1[Mn]+204.8[Cr]−0.91[RCS]>1560).

As shown in FIG. 1, in the case of Inventive Example 1, a main phase is martensite and contains a small amount (less than 10%) of ferrite and bainite. It is determined that such a second phase transformation-appears in the slow cooling and over-aging, which are essential in the ordinary continuous annealing furnace.

While example embodiments have been shown and described above, it will be apparent to those skilled in the art that modifications and variations could be made without departing from the scope of the present inventive concept as defined by the appended claims.

The invention claimed is:

1. An ultrahigh strength cold-rolled steel sheet, comprising, in percentage by weight:

C: 0.25 to 0.4%;
Si: 0.5% or less, excluding 0;
Mn: 3.16 to 4.0%;
P: 0.03% or less, excluding 0;
S: 0.015% or less, excluding 0;
Al: 0.1% or less, excluding 0;
Cr: 1% or less, excluding 0;
Ti: 48/14*[N] or more and 0.1% or less;
Nb: 0.1% or less, excluding 0;
B: 0.005% or less, excluding 0;
N: 0.01% or less, excluding 0; and
a balance of Fe and other unavoidable impurities,
wherein the cold-rolled steel sheet is an as-rolled cold-rolled steel sheet,
wherein the as-rolled cold-rolled steel sheet has a microstructure consisting of 90% or more (including 100%) of martensite, and one or two of 10% or less (including 0%) of ferrite and bainite, and
wherein the as-rolled cold-rolled steel sheet has:
a tensile strength of 1700 MPa or more, and
a yield strength of 1200 MPa or more.

2. The steel sheet of claim 1, comprising, in percentage by weight:

Mn: 3.53 to 4.0%.

3. The steel sheet of claim 1, comprising, in percentage by weight:

N: 0.0042% to 0.01%.

4. The steel sheet of claim 1, wherein a wave height (ΔH) is 3 mm or less in an edge portion after cutting a steel sheet in the width direction thereof to provide a sample 1000 mm long in the longitudinal direction.

5. The steel sheet of claim 1, wherein the microstructure consists of 90% (excluding 100%) or more of martensite, and 10% or less (excluding 0%) of ferrite and bainite.

6. An ultrahigh strength cold-rolled steel sheet, comprising, in percentage by weight:

C: 0.25 to 0.4%;
Si: 0.5% or less, excluding 0;
Mn: 3.53 to 4.0%;
P: 0.03% or less, excluding 0;
S: 0.015% or less, excluding 0;
Al: 0.1% or less, excluding 0;
Cr: 1% or less, excluding 0;
Ti: 48/14*[N] or more and 0.1% or less;
Nb: 0.1% or less, excluding 0;
B: 0.005% or less, excluding 0;
N: 0.0042% to 0.01%; and
a balance of Fe and other unavoidable impurities,
wherein a wave height (ΔH) is 3 mm or less in an edge portion after cutting a steel sheet in the width direction thereof to provide a sample 1000 mm long in the longitudinal direction,
wherein the cold-rolled steel sheet is an as-rolled cold-rolled steel sheet,
wherein the as-rolled cold-rolled steel sheet has a microstructure consisting of 90% or more (including 100%) of martensite, and one or two of 10% or less (including 0%) of ferrite and bainite, and
wherein the as-rolled cold-rolled steel sheet has:
a tensile strength of 1700 MPa or more, and
a yield strength of 1200 MPa or more.

* * * * *